US005190223A

United States Patent [19]

Mesenich

[11] Patent Number: 5,190,223

[45] Date of Patent: Mar. 2, 1993

[54] ELECTROMAGNETIC FUEL INJECTOR WITH CARTRIDGE EMBODIMENT

[75] Inventor: Gerhard Mesenich, Bochum, Fed. Rep. of Germany

[73] Assignee: Siemens Automotive L.P., Auburn Hills, Mich.

[21] Appl. No.: 673,251

[22] Filed: Mar. 20, 1991

Related U.S. Application Data

[63] Continuation of Ser. No. 419,392, Oct. 10, 1989, abandoned.

[30] Foreign Application Priority Data

Oct. 10, 1988 [DE] Fed. Rep. of Germany ..... 3834446

[51] Int. Cl.[5] ..... B05B 1/30

[52] U.S. Cl. ..... 239/585.5

[58] Field of Search ..... 239/585, 600, 533.3-533.12, 239/585.1-585.5; 251/129.15

[56] References Cited

U.S. PATENT DOCUMENTS

| | | | |
|---|---|---|---|
| 3,245,652 | 4/1966 | Roth | 251/139 |
| 3,666,232 | 5/1972 | Melcher et al. | 251/129 |
| 3,731,881 | 5/1973 | Dixon et al. | 239/585 |
| 3,876,177 | 4/1975 | Putschky | 251/129 |
| 4,007,880 | 2/1977 | Hans et al. | 239/585 |
| 4,010,390 | 3/1977 | Stampfli | 310/30 |
| 4,033,507 | 7/1977 | Fromel et al. | 239/102 |
| 4,067,496 | 1/1978 | Martin | 239/102 |
| 4,161,306 | 7/1979 | Brune et al. | 251/129 |
| 4,245,789 | 1/1981 | Gray | 239/585 |
| 4,254,653 | 3/1981 | Casey et al. | 73/3 |
| 4,365,756 | 12/1982 | Fisher | 239/533.2 |
| 4,408,722 | 10/1983 | Frelund | 239/533.12 X |
| 4,419,643 | 12/1983 | Ojima et al. | 335/234 |
| 4,511,082 | 4/1985 | Ballik et al. | 239/8 |
| 4,552,312 | 11/1985 | Ohno et al. | 239/585 |
| 4,646,976 | 3/1987 | Rembold et al. | 239/585 |
| 4,660,011 | 4/1987 | Reiter | 335/230 |
| 4,783,051 | 11/1988 | Gibas | 251/129.19 |
| 4,817,876 | 4/1989 | Hafner | 239/585 R |

FOREIGN PATENT DOCUMENTS

| | | |
|---|---|---|
| 0117603 | 9/1984 | European Pat. Off. . |
| 1014674 | 9/1959 | Fed. Rep. of Germany . |
| 1072428 | 12/1959 | Fed. Rep. of Germany . |
| 1249043 | 8/1967 | Fed. Rep. of Germany . |
| 3019418 | 11/1981 | Fed. Rep. of Germany . |
| 3110251 | 7/1982 | Fed. Rep. of Germany . |
| 3105233 | 9/1982 | Fed. Rep. of Germany . |
| 3320610 | 12/1984 | Fed. Rep. of Germany . |
| 3332801 | 3/1985 | Fed. Rep. of Germany . |
| 3501193 | 7/1986 | Fed. Rep. of Germany . |
| 3522992 | 1/1987 | Fed. Rep. of Germany . |
| 3629646 | 3/1988 | Fed. Rep. of Germany . |
| 3701872 | 4/1988 | Fed. Rep. of Germany . |
| 54-151728 | 11/1979 | Japan . |
| 498326 | 10/1970 | Switzerland . |
| 2022783 | 5/1978 | United Kingdom . |
| 2175452 | 11/1986 | United Kingdom . |

*Primary Examiner*—Andres Kashnikow
*Assistant Examiner*—Kevin Weldon
*Attorney, Agent, or Firm*—George L. Boller; Russel C. Wells

[57] ABSTRACT

A very fast electromagnetic fuel injector of cartridge design for the injection of fuel into the intake manifold of an internal combustion motor. The magnetic pole of the valve is mounted on a non-magnetizable casing which is solidly connected to a valve seat. This casing, together with the armature, the magnetic pole, and the valve seat, form a cartridge which can be manufactured independent from the other valve components. The cartridge is built into a valve housing which largely consists of plastic material. The fuel injector is therefore inexpensive to manufacture. In addition, the valve can be provided with a monostable polarized magnetic circuit.

11 Claims, 7 Drawing Sheets

ELECTROMAGNETIC FUEL INJECTOR WITH CARTRIDGE EMBODIMENT

This is a continuation of copending application Ser. No. 419,392 filed on Oct. 10, 1989 now abandoned.

FIELD OF THE INVENTION

The subject of the invention is a miniature electromagnetic fuel injector intended for the bulk injection of fuel into the suction pipe of combustion motors. The fuel pressure preferably is in the order of 1–4 bar.

BACKGROUND OF THE INVENTION

There exist a large number of electromagnetic injection valves for the purpose of fuel injection into the suction pipe of combustion motors. A common characteristic for these injection valves is a desire for high dosage accuracies. Such high dosage accuracies can be achieved only with very short opening and closing times. Opening and closing times for the best known valves are 0.5–1.5 ms, depending somewhat on the impedance of the electromagnet. The required short closing times should be achieved with the lowest possible input of electrical energy.

State of the art valves typically are of axially symmetric design. The armature of such valves is located at the central axis of the valve and acts on a valve obturator which in most cases is of needle-type design. The outside diameter of these valves is in general 20–25 mm Magnetic return flow usually is by means of a massive metallic housing which provides the base for both the magnetic pole and the valve seat. This housing must be precision made to prevent unacceptable dislocations of the magnetic pole. Usually this results in a series of narrowly defined precision tolerance limits which are difficult to achieve in production, or it is necessary to select component parts which fit precisely to each other. In order to prevent objectionable armature bounce, and in order to achieve short floating times, the conventional injectors feature only very small stroke heights. Stroke heights of modern injector valves are in the range of 0.05–0.1 mm. In order to prevent unacceptable variations in flow-through characteristics, the state of the art valves require extremely tight machining tolerances. In addition, state of the art valves require a difficult calibration procedure.

SUMMARY OF THE INVENTION

It is the objective of this invention to define a very fast, low armature bounce fuel injector with low exceptionally low cost.

The fuel injector according to the instant invention, in variance from state of the art designs, features a non-magnetizable casing which is solidly joined with the magnet pole and the valve seat, and serves as the radial guidance element of the armature. The casing, together with the components contained therein, forms a cartridge which is mounted inside the valve housing. Thus, only the cartridge requires precision manufacture, allowing for broad tolerances with respect to the valve housing. Functional testing of the cartridge can be done independent from the other mounting parts during an early manufacturing stage. This simplifies manufacture of the total valve considerably, rejects are reduced. Loss of a complete valve in case of possible performance problems is thus avoided. Furthermore, no seals are required inside the cartridge. Sealing requirements cause increased reject losses during manufacture of state of the art valves, rendering the complete injector useless. The therefore inexpensive to manufacture. The fuel injector has small overall dimensions, the external diameter in general is 14–16 mm. The valve is therefore readily adapted to the most varied mounting conditions.

Some of the special function characteristics of the valve according to the instant invention will be further detailed in FIG. 1.

DESCRIPTION OF THE PREFERRED EMBODIMENT

Figure 1:
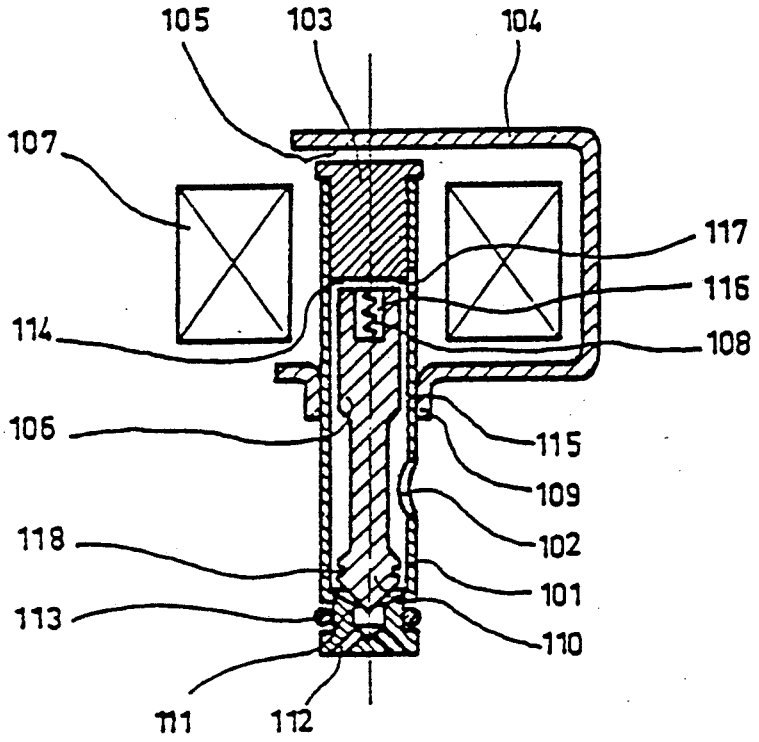
FIG. 1 is a longitudinal cross section through a first embodiment.

The magnetic circuit of the injector according to FIG. 1 consists of magnet pole 103, armature 106 and bracket 104. Magnet pole 103 and armature 106 are encircled by magnet coil 107. Bracket 104 terminates in collar 109, which forms the side-pole of the magnetic circuit. By means of collar 109, the side-pole area is enlarged, which reduces the magnetic resistance between armature 106 and bracket 104. In the energized state, armature 106 closes directly against magnet pole 103. Arrangements for an additional permanent air gap 105 are made between magnet pole 103 and bracket 104, this gap is used for the dynamic calibration of the valve. The bearing for magnet pole 103 is provided by the non-magnetizable casing 101, which also serves as the radial guidance element of armature 106. Inside armature 106 provision is made for reset spring 10B. Armature 106 terminates in cone-shaped obturator 110. Casing 101 also contains valve seat 111 and nozzles 112. Casing 101, magnet pole 103, armature 106, and valve seat 111, which is inside the casing, jointly form a cartridge which can be manufactured independently from parts which are extraneous to the cartridge. Fuel delivery to the valve seat is via side orifice 102 in the casing. The valve seat region is sealed against the valve housing, which is not drawn, by means of gasket ring 113.

The design according to FIG. 1 offers many additional advantages over state of the art valves which are not directly obvious. First of all, there is the advantage that only few precision parts are required, and these are of uncomplicated geometric shapes. Armature stroke, and thus the static flow characteristics, are only a function of the insertion depth of magnet pole 103. Armature stroke remains unaffected by any possible tolerance deviations in the valve housing. Exact centering of armature 106 with respect to magnet pole 103 and valve seat 111 is obtained simply by their common placement inside casing 101. By the same principle, it is easy to maintain the required parallel alignment between magnet pole and armature in the area of the working gap 114. The cartridge design of the valve makes it possible to carry out initial performance testing during early manufacturing stages.

In addition, the valve features several special features with respect to magnetic characteristics. Magnetic return flow is via slide-on bracket 104. Bracket 104 is open on one side, only partially enclosing magnet coil 107 at its outer perimeter. This results in an increase of magnetic resistance between the parts of the magnetic circuit which are inside the magnetic coil (magnet pole and armature), and the section which is outside the magnetic circuit (bracket). Thereby the stray field of the magnetic circuit is reduced, resulting in greater effectiveness of the electric energy conversion. In addition, inside the magnetic circuit several additional gaps are provided, approximately evenly distributed in the flow of the magnetic field lines. Working gap 114 is arranged inside the magnetic coil, calibration gap 105, and side-gap 115, which is formed by the non-magnetic casing 101, are disposed outside magnetic coil 107. In the energized state, armature 106 closes directly against magnet pole 103. In contrast to state of the art valves, no permanent air gap is present between pole 103 and armature 106. Such permanent air gaps must usually be maintained with great precision.

The dimension of the permanent air gap generally is of the same order of magnitude as the armature stroke in case of state of the art valves. Even small changes in the permanent air gap from the set value must then be compensated for by relatively significant changes in the reset spring force. Significant variations from the set point value of the spring are not desirable since they can result in variations of the dynamic flow-through characteristics for the case that the trigger voltage fluctuates. By omitting the permanent air gap in line with the design according to FIG. 1, improved electromagnetic efficiency is obtained; a sufficiently fast collapse of the magnetic field, after cutting off the excitation current, is virtually forced by calibration gap 105 and side-gap 115. The overall efficient magnetic design of the circuit makes it possible to reduce its dimensions, without also reducing the magnetic effectiveness in comparison with state of the art valves. This makes it possible to use a small diameter armature which, of course, means an armature with very low mass. In total, the valve permits very fast floating times, coupled with low electric energy consumption.

The special feature connected with this valve is found in the additional permanent air gap 105, which serves for dynamic calibration. A change in air gap 105 causes a change in the magnetic resistance of the magnetic circuit. Enlarging air gap 105 causes a delay in pickup and a decrease in drop off. This allows calibration of the dynamic flow characteristics by setting air gap 105 to desired values.

Dynamic calibration by means of air gap 105 offers a number of distinct advantages. For a start, such calibration possibilities allow for considerably larger tolerances in the spring resiliency characteristics of reset spring 108. Furthermore, calibration is more stable even in the case of changing excitation voltages, since the spring force is approximately the same for different valves. Due to the approximately even distribution of the individual air gaps in the pathway of the magnetic field, a decrease in the stray magnetic field results, and thus an improvement of electromagnetic efficiency.

Magnetic coil 107 is slipped sidewise into bracket 104. Bracket 104 can be thin-walled, since it has no load bearing function with respect to magnetic pole 103. In contrast, state of the art valves require rather thick-walled housings to prevent unacceptable dislocations of the magnetic pole. Since magnetic coil 107 is only partially enveloped, it can readily be embedded in plastic, together with the contact pins. This prevents possible leakage paths, and the heat transmission of the coil is improved. The reject losses often incurred during the manufacturing process are reliably precluded. The result is a stable and compact housing design, inside of which the cartridge valve is well protected from mechanical damage.

Calibration of the injector proceeds in several separate steps. At first, reset spring 108 is inserted into armature 106, it is to be noted that with regard to spring resiliency, relatively large tolerance values are allowable. Generally, no special selection process with respect to spring resiliency is necessary. Then, the static fuel flow characteristics, or respectively the armature stroke, is set by pressing magnet pole 103 into casing 101 to a desired depth. Dynamic calibration is housing (not drawn) to the desired depth. This changes the distance between pole 103 and bracket 104.

In addition, the valve exhibits some special features with respect to hydraulic design. To start, reset spring 108 is positioned in a chamber 116 which is open at one end and is located inside of armature 106. Annular pole surface 117 of pole 103 features engraved hydraulic damping slots which attenuate armature movement and permit fuel to flow into chamber 116 even while the armature is in the closed position. This prevents hydraulic sticking of armature 106 at magnet pole 103. The damping slots are arranged in such a manner that between them three contact areas result which are distributed evenly around the circumference of the armature pole surface. The contact surfaces should extend radially over the total width of annular pole area 117. Chamber 116 enhances the damping effects of the hydraulic damping slots. The depth of the slots should be about 10–20 micrometers. At this depth, good hydraulic damping of the closing movement of the armature is obtained, without also resulting in unacceptable damping of the reset step. Because of hydraulic damping in working gap 114, relatively soft material can be used in this region without resulting in unacceptable wear. The design of the hydraulic damping gaps in particular is described in a separate application U.S. Ser. No 07/419,376 filed Oct. 10, 1989.

The injector also is characterized by steady state characteristics where the hydraulic reset forces for the energized armature are larger than for the armature in reset position. Given such steady state characteristics, the drop-off time of the armature is considerably shortened. To achieve this, the valve obturator 110 of armature 106 is internally guided by casing 101 with a slight amount of radial play of some 1/100 mm. This results in an annular gap which surrounds obturator 110. Inside this gap a pressure drop results which grows with increasing flow, and therefore with increasing armature stroke. Due to this pressure drop, as the armature stroke increases, a hydraulic force is generated which opposes the magnetic force. The radial play of the obturator is set in such a way that for the energized armature a permanent pressure drop of about 10–20% of the static fuel pressure is produced behind the annular gap. The diameter of the annular gap should be chosen to be 2–3 times larger than that of valve seat 111. For the dimensions stated, the obturator is hydraulically centered, and impacting of the obturator onto the valve seat is dampened. The employment of hardened materials for both obturator and valve seat does not have to be considered for the dimensions stated. By dampening the reset movement, armature bounce is significantly reduced. The obturator also features a groove 118, which serves to increase the permanent pressure drop and to uniformly distribute the pressure drop around the perimeter of the annular gap.

The hydraulic reset feature and the defined steady state characteristics are especially useful for multipoint injection where each motor cylinder is separately supplied with fuel by an individual injector. Multipoint injection requires only a minimal amount of fuel flow which can be achieved already with a small diameter of valve seat 111. Valve seat diameters in general need not be larger than 1–2 mm. The stated dimensions can thus be implemented already for an obturator diameter of 3–4 mm.

Making use of the hydraulic reset principle according to the invention would really allow the complete omission of reset spring 108, without this resulting in unacceptably long reset times. However, without a reset spring increased leakage can occur in the seating area because of the small hydraulic force during the closed valve position. Under practical conditions, a reset spring should always be provided to prevent leakage in the closed valve position.

Figure 2:
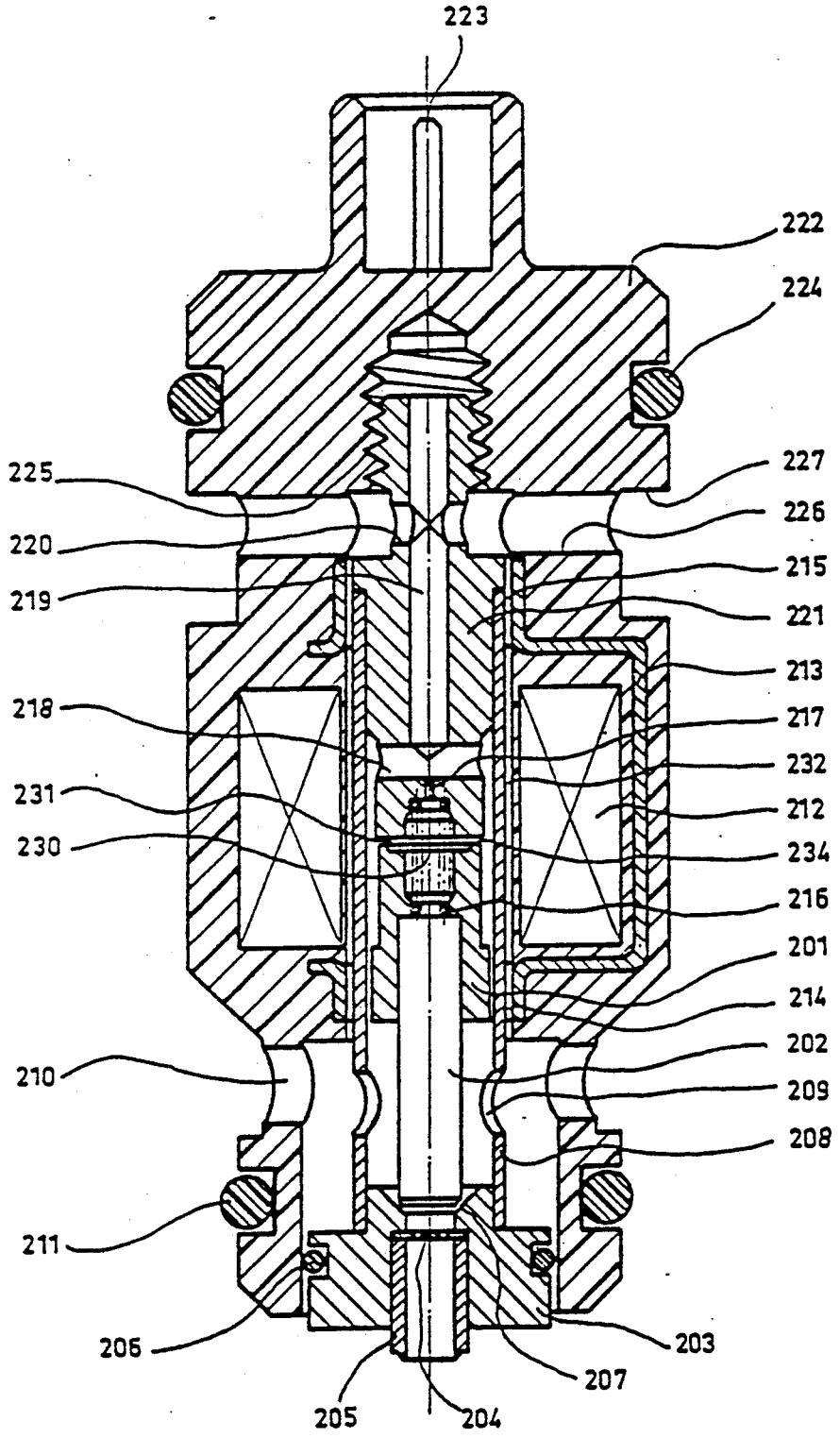
FIG. 2 is a longitudinal cross section through a second embodiment.

Specific designs of injection valves according to the invention are detailed in the following by several examples:

The injector shown in FIG. 2 features a plastic housing 222. Magnetic coil 212 and connection pins 223, as well as bracket 213, are encased by injection-moulded plastic. The upper part of housing 222 carries a threaded segment 225 into which the valve cartridge fits. The magnetic circuit of the valve consists of armature 201, magnetic pole 221 and bracket 213. These components of the magnetic circuit consist of ferro-magnetic material. Magnetic pole 221 is mounted in non-magnetizable casing 208. Mounting is preferably by pressure insertion, followed by laser welding. At the bottom end of casing 208, valve carrier 203 is pressed in and welded. Reset spring 216 is located inside armature 201. Reset spring 216 is located on valve needle 202 which is pressure fitted into armature 201. Reset spring 216 is held by chamber 230, located inside pole 221 and armature 201. Chamber 230 is closed off to the side for the energized armature. At the top of chamber 230 a drilled passage 217 is arranged which connects chamber 230 with the outer volume. Passage 217 reduces the danger of steam bubbles in the upper section of chamber 230, and also decreases the possibility of hydraulic sticking of armature 201 at pole 221. Furthermore, an additional damping effect of armature movement can be obtained by reducing the diameter of orifice 217 to 0.2–0.4 mm so that the outflow of fuel from chamber 230 towards- the end of armature movement is restrained. On the face surface of armature 201 a circumferential damping slot 231 is provided, which attenuates armature movement. This damping slot additionally results in hydraulic parallel guidance of the armature. Based on this hydraulic parallel guidance, the flow conditions at valve seat 207 are easily reproducible without requiring radial guidance for the valve needle in the region of valve seat 207. The diameter of valve needle 202 is approximately 2 mm, that of the armature is about 4 mm. The cone shaped valve seat 207 is machined into valve carrier 203. Valve carrier 203 also serves as the mounting location for nozzle plate 204 in diffuser 205, both are securely clamped in position. The valve is continuously perfused by fuel. Fuel enters via side orifice 210 into the lower section of valve housing 222. From there the fuel path proceeds via side passage 209 in the casing to valve seat 207. Between casing 208 and surrounding housing 222 there is an annular channel 232 which serves as fuel passage. In addition, annular channel 232 results in a floating mounting arrangement for the cartridge valve, so that virtually no radial forces from housing 222 can be exerted on the cartridge valve. From the lower section of the cartridge valve, fuel reaches the upper housing region via passages 218, 219, and 220. From there, the fuel proceeds via orifice 226 into circumferential annular channel 227, and from there to fuel recycle. Housing 222 is sealed in the mounting hole by means of gasket rings 211 and 224. The cartridge valve is sealed against the housing by means of gasket ring 206, which is located on valve carrier 203. Housing 222 is surrounded by a fuel filter, which has not been drawn.

Dynamic calibration of the valve is achieved by changing the axial location of the cartridge valve with respect to housing 222. Positioning is done by threading the cartridge to a given depth. As the exact location of the cartridge changes, the relative locations of the working pole in relation to the magnetic coil, and the overlapping in the area of side-gaps 214 and 215 is changed. During this positioning process, two magnetic parameters are being used for calibration: on the one hand a change in the stray field, by the relative positions of working pole and magnetic coil, on the other hand a change in magnetic resistance by the changes in the overlap of the side-gaps. In this case, the radial arrangement of upper gap 215, in comparison with the axial arrangement of calibration gap 105 in FIG. 1, results in lower sensitivity. Thus, in order to obtain an equivalent change in dynamic calibration, the design according to FIG. 2 requires greater axial dislocations. This renders the valve less sensitive to possible changes in the position of the cartridge valve, such changes might, for instance be caused by aging effects or by improper handling. Furthermore, this makes possible larger tolerances in the housing area.

Figure 3:
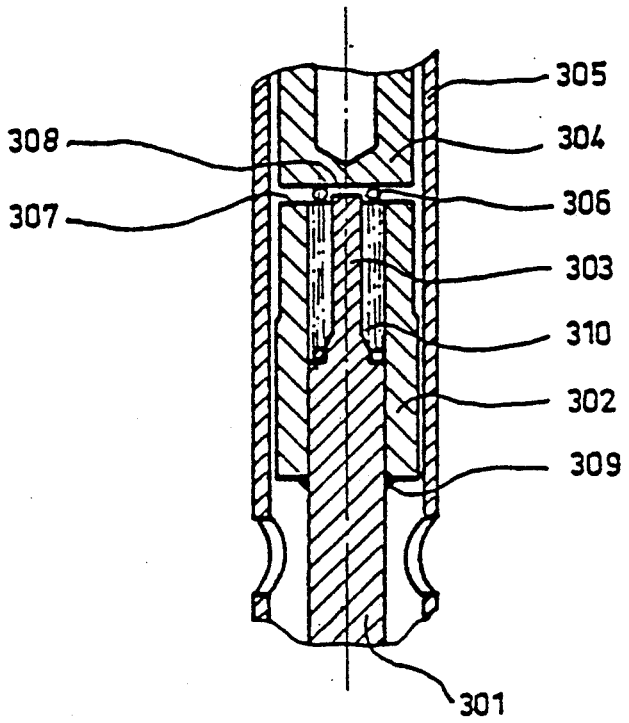
FIG. 3 is a longitudinal cross section through a third embodiment.

A further advantageous design of armature and valve needle, with respect to magnetic principles and kinematic concerns, is shown in FIG. 3. This type of armature design is preferably used for valves of the type described in FIG. 2. In this case, tubular armature 302 is directly pressed onto valve needle 301; the armature seals against pole 304 with closing pin 303. The diameter of valve needle 301 is about 2 mm. Closing pin 303 has a diameter of about 1 mm. The reset spring 306 is inside armature 302, mounted on closing pin 303. Armature 302 is pressed onto valve needle 301 and further secured against dislocations by welding bead 309. The contact surface of closing pin 303 extends about 20 micrometers armature armature surface 307, resulting in an annular damping slot in the pole region.

The advantage of the design according to FIG. 3 is to be found in exceptionally effective damping of the closing movement of the armature with only minimal hydraulic sticking. This damping effect is obtained by displacement of fluid from the annular chamber 310, located inside the armature, which results in an especially strong damping effect. Because of the very small closing surface of pin 303, hydraulic sticking is prevented. In addition, it is of advantage that no limit stop is present in the working pole area, in contrast to the design in FIG. 2. This results in a faster decay of the magnetic field after cutting off the energizing current.

Figure 4:
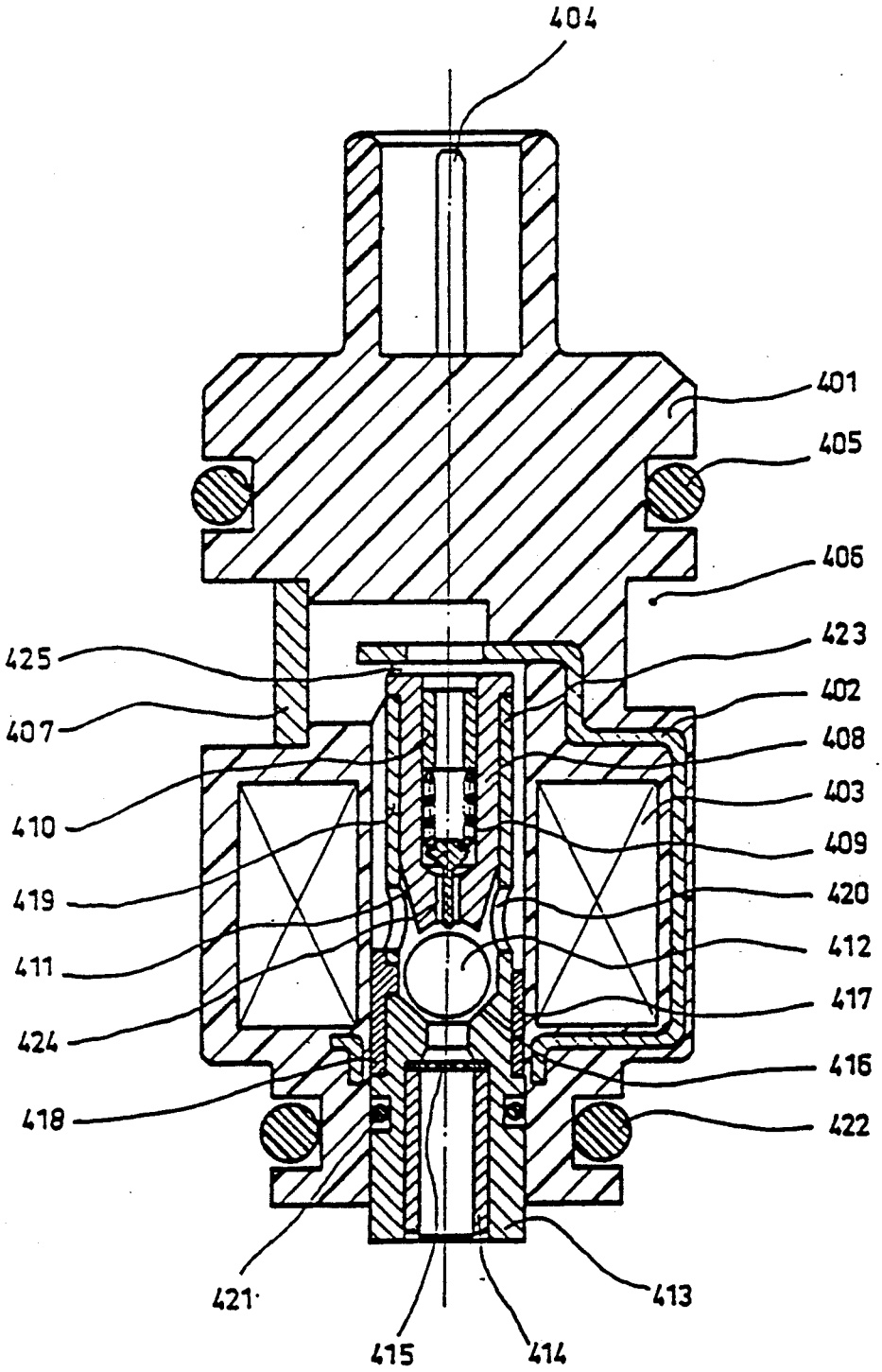
FIG. 4 is a longitudinal cross section through a fourth embodiment.

FIG. 4 describes a valve of especially small dimensions, equipped with a ball armature. Armature diameter is preferably about 2.5–3 mm. Housing diameter is about 14 mm. Magnetic features are those of the valve design according to FIG. 1. The magnetic circuit of the valve consists of armature 412, magnetic pole 408, and bracket 402. The working gap of the magnetic circuit is located about in the middle of the coil. Around armature 412, an additional side-pole is arranged. Two different designs are represented: in the right half of the drawing, side-pole 417 has been pressed onto non-magnetizable casing 423. This approach is inexpensive, but less advantageous from magnetic considerations. In this case an air gap with high resistance is produced by the non-magnetic casing 423 which is located between armature 412 and side-pole 417. The high resistance is conditioned by the especially small surface on the side of ball-armature 412 which faces side-pole 417. For an armature of such small dimensions, the approach detailed in the left half of the drawing is better from magnetic considerations. In this case, side pole 418 has been extended close to armature 412. Armature reset is by means of reset spring 409. Reset spring 409 is held on the upper side by small pressure fitted tube 410, at the lower side it is held by pressure pin 411. Pressure pin 411 in turn is housed in drill hole 424 in pole 408. In the right half of the drawing, pole 408 is mounted directly on valve carrier 413; both valve seat 416 and the space for pole 408 are machined into valve carrier 413. In the left half of the drawing, pole 408 is mounted on non-magnetic casing 419, which is joined to side-pole 418. Side-pole 418 is connected to valve carrier 413. Nozzle plate 415 is clamped by diffuser 414 in valve carrier 413. Fuel supply is via annular channel 406 through filter 407 into the interior of housing 401. From there the fuel path proceeds on the outside of the cartridge via orifices 420 to valve seat 416. Bracket 402, magnetic coil 403 and connection pins 404 are embedded in injection-moulded plastic during manufacture of housing 401. Dynamic calibration is by means of the insertion depth of the cartridge valve, this changes calibration gap 425. The cartridge valve is sealed through gasket 421, the housing is sealed with gaskets 405 and 422.

Figure 5:
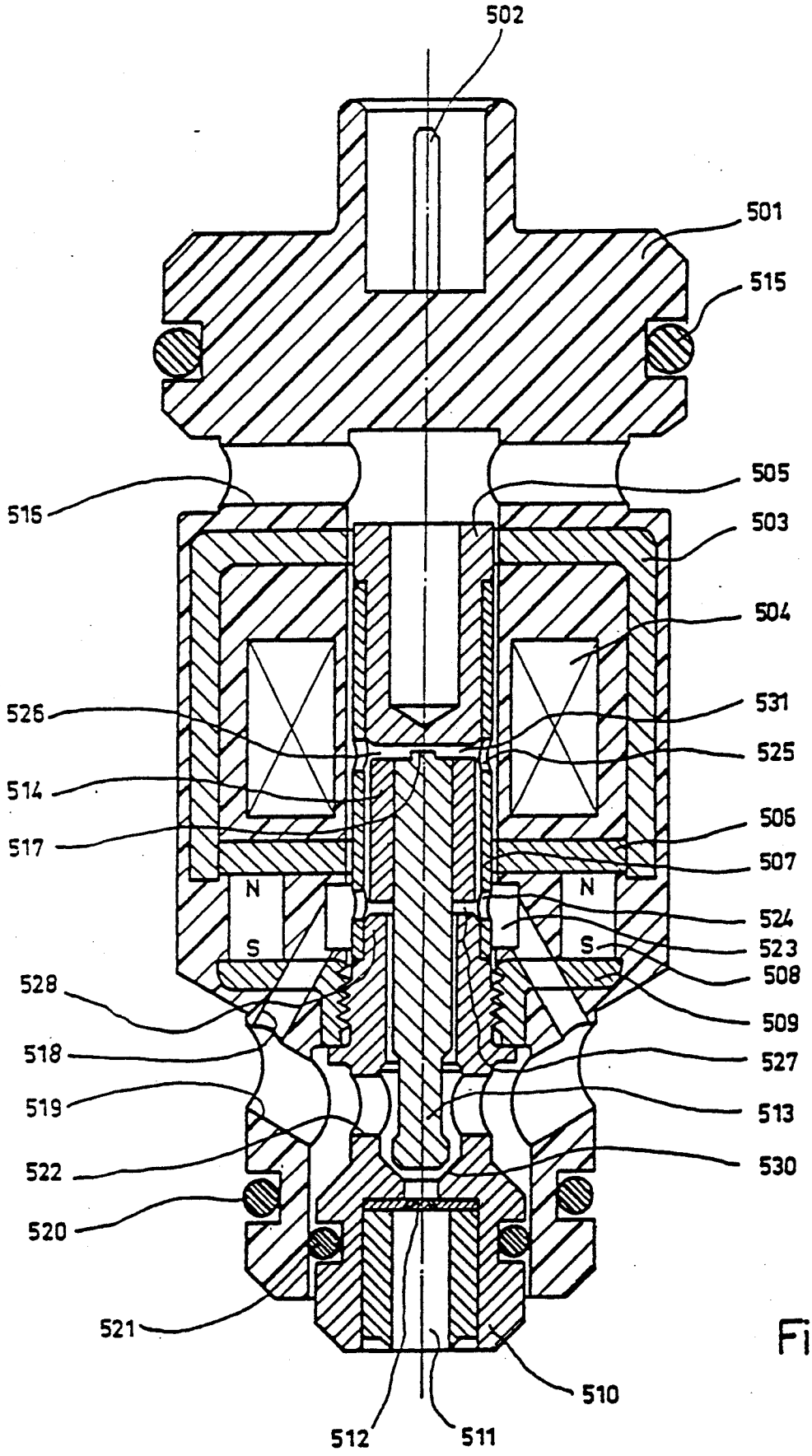
FIG. 5 is a longitudinal cross section through a fifth embodiment.

FIG. 5 describes a valve where the armature reset is effected by means of a permanent magnet. This allows omission of the otherwise necessary reset spring. Dynamic calibration of the valve is by means of an externally generated alternating magnetic field.

The electromagnetic circuit of the valve consists of armature 514, working pole 505, return flow cap 503 and side-pole 506. The electromagnetic circuit encloses magnetic coil 504. The permanent magnetic circuit consists of armature 514, side-pole 506, permanent magnet 508, pole fixture 509 and resting pole 528. Resting pole 528 has been machined into valve carrier 510. Armature 514 has been pressed onto valve needle 513. With coil 504 in the unenergized state, armature 514 is drawn in the direction of resting pole 528 under the influence of the permanent magnetic field; valve needle 513 in this case closes against valve seat 530. For the closed valve, a permanent air gap 527 remains between armature 514 and resting pole 528. The depth of this permanent air gap should be about the same as the armature stroke and be at least 0.1 mm. For a lesser dimensioned air gap 527 the closing force at the end of the stroke movement would be too strong. Such strongly increasing closing forces are unfavorable for the dynamic characteristics of the valve. Additionally, there exists a stray field from permanent magnet 508 which interacts with the electromagnetic circuit. Thus, part of the magnetic field passes through the permanent air gap 526, causing a permanent pull in this area. In order to minimize this pull for the case of the attracted armature, a permanent residual gap is necessary in the area of working gap 526. Without this permanent residual gap there is a danger of hydraulic sticking of armature 514 at working pole 505. The width of this residual gap at the working pole need only be 10–20 micrometers. Because of the small dimension required for the residual gap, its function can be fulfilled by the engraved hydraulic damping slot 531 which simultaneously serves to hydraulically attenuate the armature movement. Valve needle 513 is radially guided inside valve carrier 510. Valve carrier 510 also contains nozzle plate 512 which is clamp-fastened by diffuser 511. Valve carrier 510 is threaded into pole fixture 509. Non-magnetizable casing 507 is pressed onto valve carrier 510, it provides the mounting base for working pole 505. Fuel supply is via orifices 519 in the lower section of housing 501. Fuel passes then through slanted channels 518 into annular channel 523, and from there along the outside of the cartridge into the upper housing section. The armature region is connected to the outer volume of the cartridge by side passages 524 and 525. These orifices can be executed in relatively small diameters in order to obtain additional attenuation of the floating movements of the armature. From the upper housing section, fuel passes through radial channels 516 to fuel recycle. The valve cartridge is sealed against housing 501 by gasket ring 521. The outer segments of the magnetic circuit are embedded in injection-moulded plastic, together with coil 504 and connection pins 502.

Assembly of permanent magnet 508 can be done in the unmagnetized state in order to facilitate handling. To magnetize 508, the poles of a magnetizing circuit are attached close to return flow cap 503 and pole fixture 509. This generates a magnetic circuit which consists of the permanent magnet and the magnetizing device. ., Permanent magnet 508 is then magnetized by the externally applied magnetic field.

Calibration of the valve is done in several sequential steps. At first, a suitable armature with valve needle is matched with the valve carrier so that the preset permanent air gap 527 in the rest-pole area is produced. Because of the relatively large dimension of permanent air gap 527, matching of suitable parts allows for relatively large tolerances. Then working pole 505 is pressed into casing 507 in such a manner that the desired armature stoke is established. Dynamic calibration of the valve is done after complete assembly. To this effect an alternating magnetic field is applied to the permanent magnet, using a suitable magnetizing device, which causes it to be weakened and at the same time become stabilized with respect to magnetic properties. For increasing weakening of the permanent magnet the reset time of the valve is lengthened. Pick-up time can be shortened or the flow direction of the current through coil 504. The effect of weakening the permanent magnet is considerably larger with respect to reset time, thus allowing always for the desired change in calibration. To obtain the best possible effectiveness for the valve, the direction of the current through coil 504 should be chosen in such a way that the coil-generated field is co-directional to the Armature drop-off can be accelerated by a brief counter pulse.

Figure 6:
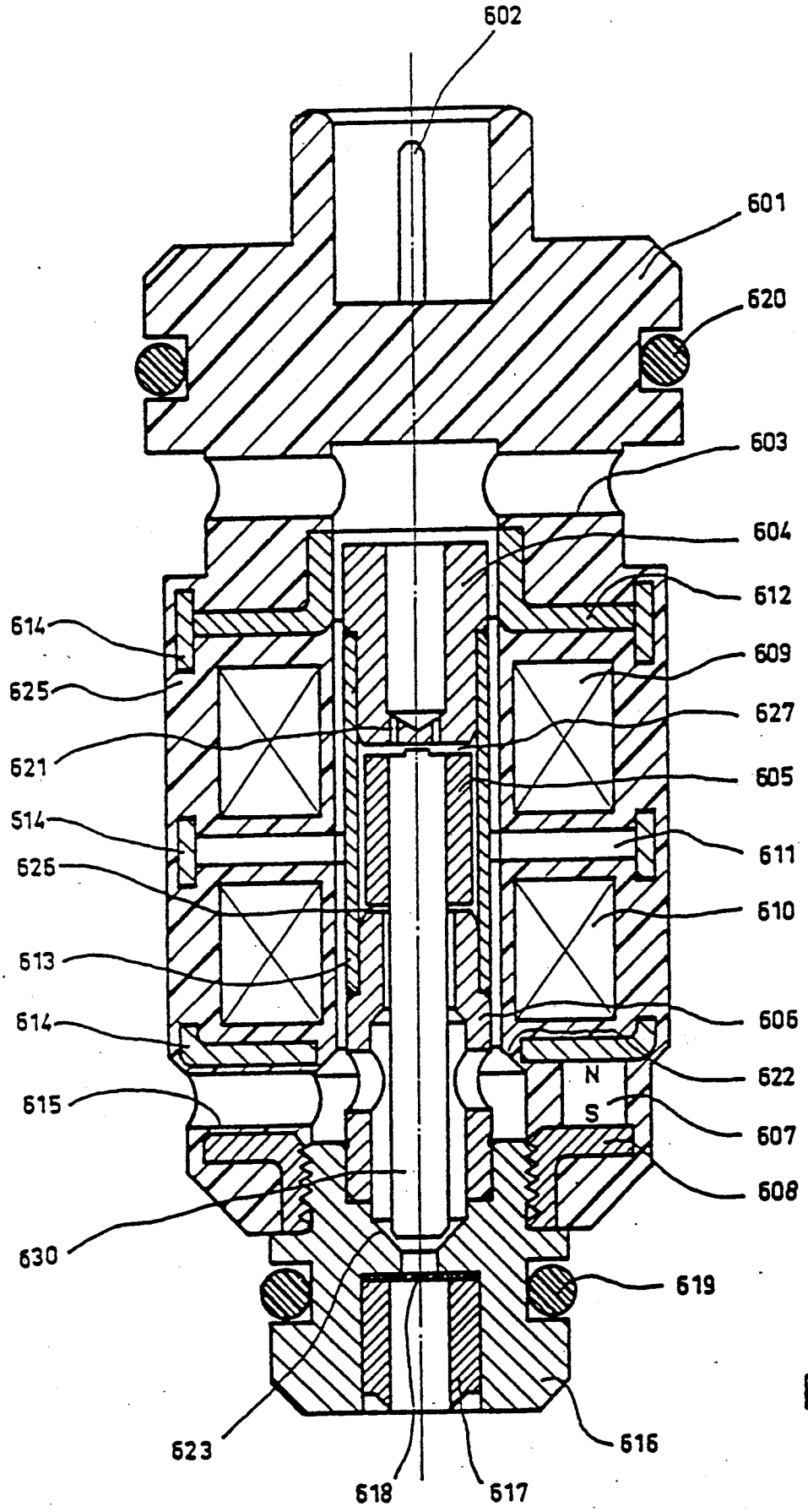
FIG. 6 is a longitudinal cross section through a sixth embodiment.

FIG. 6 describes another valve where armature reset is by means of a permanent magnet. In contrast to the valve according to FIG. 5, in this design an additional magnetic coil 610 has been installed near the permanent magnet. The valve features two magnetic circuits with opposing magnetic fields. In contrast to the familiar polarizable magnetic circuits, permanent magnet 607 is positioned on one side only, resulting in a mono-stable behavior mode. Mono-stable behavior is characterized by the fact that the valve returns automatically to the closed position as the energizing current is cut, without requiring an electrical counter pulse. Mono-stable behavior is a safety requirement for injector valves, so that closing of the valve is guaranteed even for possible service interruptions of the electric triggering circuits. The cartridge design of the injector, in line with the cost effective construction of the magnetic circuit. For comparable dynamic behavior, electric energy consumption is considerably less than for state of the art valves.

The upper magnetic circuit for the valve consists of working pole 604, armature 605 and return flow cap 614. The lower magnetic circuit consists of armature 605, side-pole 611, return flow cap 614 and rest-pole 606. The upper magnetic circuit surrounds magnetic coil 609, the lower magnetic circuit surrounds magnetic coil 610. The permanent magnetic circuit is parallel to the lower magnetic circuit. The permanent magnetic circuit consists of permanent magnet 607, pole fixture 608, rest-pole 606, armature 605, side-pole 611, and return flow cap 614. The latter is perforated and thus only partially visible. In addition, a side-gap 622 is provided between rest-pole 606 and return flow cap 614, the side-gap serves to stabilize the demagnetization curve of the permanent magnet. All segments of magnetic circuits consist of magnetically soft material. For the unenergized valve, due to the asymmetric positioning of the permanent magnet, a strong magnetic field establishes itself between armature 605 and rest-pole 606, this field acts toward closing of the valve. In the working gap region only a relatively small stray field of the permanent magnet is active. Magnetic sticking of armature 605 for the unenergized valve is prevented by permanent air gap 627, which is also designed as a hydraulic damping slot. The resting-gap 626 should preferably have a length of about 20 micrometers, it may also be longer for practical reasons. Armature diameter should be about 4 mm. The magnetic circuits are connected , in such a way that for the energized state the magnetic field of the upper coil 609 is co-directional with the field of the permanent magnet, while that of the lower coil 610 is opposed to the field of the permanent magnet. Armature reset can be considerably accelerated by a brief counter pulse. Such a counter pulse can be generated in especially simple fashion by connecting a condenser in parallel to the triggering circuit.

Armature 605 is pressed onto valve needle 630 and can additionally be welded to same. Valve needle 630 is radially guided inside rest-pole 606. Rest-pole 606 is pressed into valve carrier 616 and welded to it. Resting-gap 626 can be set by pressing rest-pole 606 to the corresponding depth into valve carrier 616. The and provides the mounting base for working pole 604. Working pole 604 contains damping passages 621 which provide fuel entry and exit to the armature region. The outer sections of the magnetic circuit, together with contact pins 602 and the magnet coils, are completely embedded in injection-moulded plastic during manufacture of the housing. In order to allow for passage of the plastic, individual parts of the magnetic circuit are provided with large scale perforations. Permanent magnet 607 is assembled from several segments, between these orifices 615 are provided, which serve as fuel inlets. Fuel passes along the outside of the cartridge valve into the upper housing region and from there via side passages 603 to recycle. The valve is sealed in the mounting opening by means of gasket rings 619 and 620. Lower gasket ring 619 is located directly on valve carrier 616, making a separate seal of the cartridge valve against housing 601 unnecessary. The cartridge valve is threaded into the lower pole fixture 608 and float-mounted inside housing 601.

Magnetization of the permanent magnet and calibration of the valve are analogous to the procedures described for FIG. 5. Dynamic calibration is by means of weakening the permanent magnetic field through application of an alternating magnetic field. The alternating magnetic field can also be applied by overexciting the magnetic coils of the valve with alternating current.

Figure 7:
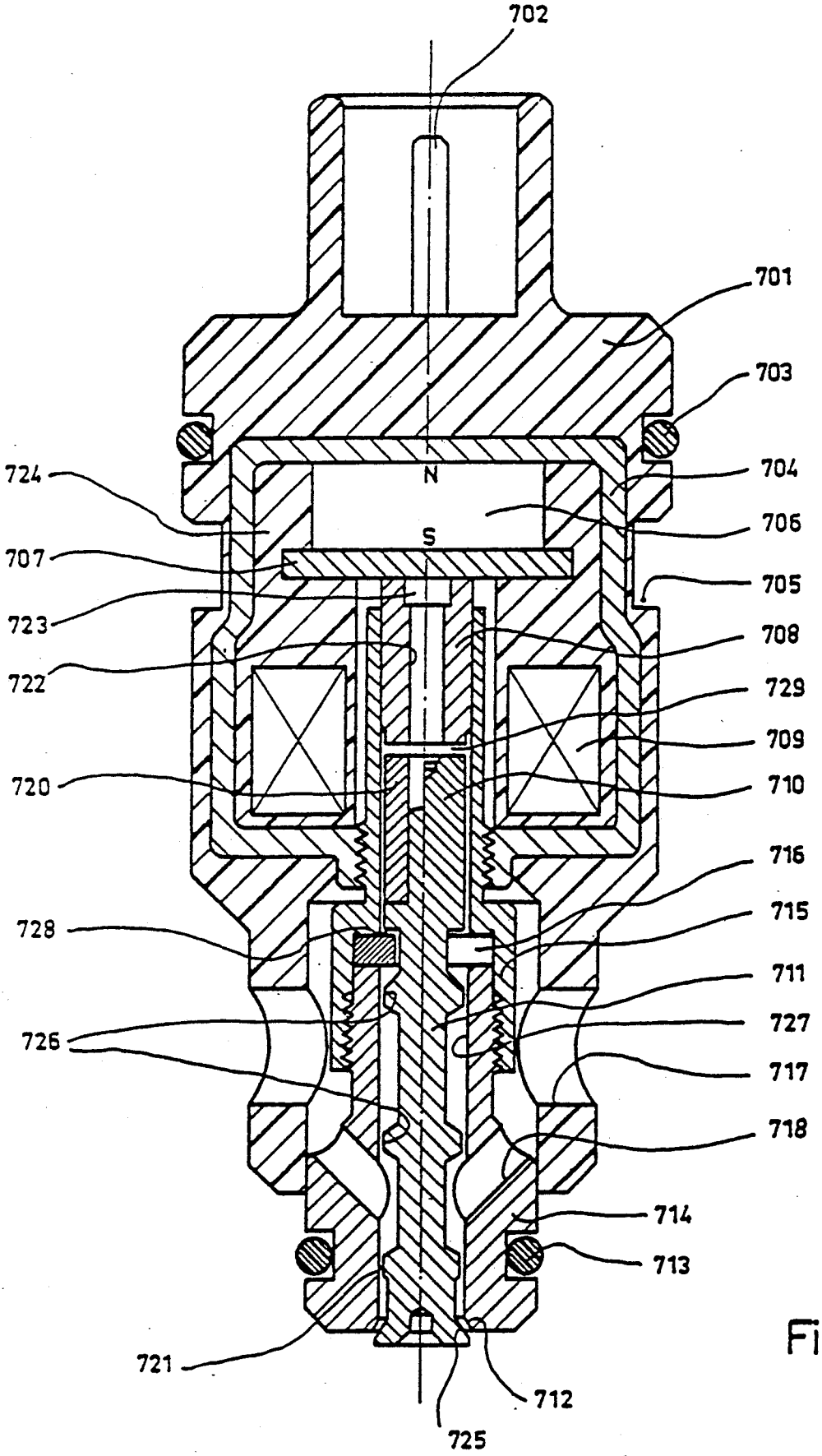
FIG. 7 is a longitudinal cross section through a seventh embodiment.

FIG. 7 describes a further cartridge valve which is characterized by a polarized magnetic circuit. The basic design of the magnetic circuit is familiar. This state of the art magnetic circuit features two permanent air gaps which are located below the magnetic coil. This state of the art magnetic circuit exhibits the disadvantage of increased sensitivity towards possible canting of the armature. In addition, the state of the art valve has a larger stray field, caused by the larger magnetic resistance of the double working poles and the magnetically unfavorable location of the poles. In addition, for a double working pole an especially strong and undesired decrease of the permanent magnetic force occurs for increasing stroke height. The valve according to the present invention, in contrast, only features a single permanent air gap, which, furthermore, is located inside the magnetic coil. Because of the single permanent air gap the magnetic resistance of the magnetic circuit is reduced. This results in a reduction of the stray field, and thus in an improvement of the effectiveness. The undesired drop off of the permanent magnetic force with increasing armature stroke is considerably reduced. The improved electromagnetic effectiveness makes it possible to employ an armature with especially small external diameter. Thus, the armature, at about 2.5–3 mm, virtually has the diameter of the valve needle guidance, allowing for considerably simplified valve construction. In addition, the valve according to the instant invention allows for dynamic calibration by means of an externally applied alternating field, again, simplifying manufacture.

The electromagnetic circuit of the valve consists of magnetic pole 708, armature 710, return flow bracket 704 and pole fixture 707. The armature diameter is about 2.5–3 mm. The electromagnetic circuit encloses magnetic coil 709. The permanent magnetic circuit is connected parallel to the electromagnetic circuit. The permanent magnetic circuit consists of permanent magnet 706, pole fixture 707, bracket 704 and the magnetically effective side air gap 724. Side air gap 724 is necessary to prevent a permanent weakening of the permanent magnetic field under the influence of the electromagnetic field. For the case of the unenergized coil, armature 710 is pulled in the direction of magnetic pole 708, being under the influence of the parallel connected permanent magnetic field. Armature 710, together with valve needle 711, jointly form a valve pin. The valve pin features guide noses 726, proportioning slot 721, and obturator 725. It is indicated to surface-harden the valve pin by nitration, or otherwise provide it with an anti-wear coating. Alternatively, the valve pin may also be equipped with a separate armature 720, which is pressed on, as shown in the left half of the drawing. Separate arrangements for armature and valve pin allows for use of an armature consisting of soft material. For assembly, the valve pin is inserted from below into the receiving cavity 727. Side spacer 716 prevents the pin from falling out. For the open valve, the valve pin seats with collar 728 on spacer 716. Spacer 716 can be provided with hydraulic damping slots to prevent hydraulic sticking. The stroke of the pin is set by selecting spacer rings of appropriate thickness. Spacer 716 is prevented from falling out by the threaded non-magnetizable casing 715. Magnet pole 708 is pressed into casing 715. Between pole 708 and armature 710 remains a permanent air gap 729 for the closed valve, which should be as short as possible. The cartridge design of the valve allows for a very small permanent air gap 729 without excessive manufacturing problems. The cartridge valve is inserted into housing 701 from below and thread mounted in bracket 704. This causes magnetic pole 708 to rest on pole fixture 707. Fuel supply is via side openings 717 and 718. Fuel then passes along the outside of the cartridge into the upper section of housing 701. From inside the cartridge, fuel passes via central passage 722 and side slot 723 into the upper section of housing 701. From there, the fuel passes via a passage which is not visible in the drawing to the outer annular channel 705. The parts of the magnetic circuit which are external to the cartridge valve are embedded in injection-moulded plastic, together with coil 709 and contact pins 702, when housing 701 is produced. The valve is sealed by means of gasket rings 713 and 703 in the mounting orifice. Dynamic calibration is by means of an externally applied alternating field. The poles of the magnetizing device are connected near bracket 704 and pole fixture 707 to carry out the procedure.

In conclusion it should be noted that the valve according to the instant invention can also be provided with a connection piece which is located in the central axis and serves as fuel supply device. The contact pins for the magnetic coil are then moved to the side. With such an arrangement, the design is externally similar to state of the art needle injector valves. The valve is then directly exchangeable for one of these state of the art devices. The central fuel connector can also be directly attached to the magnetic pole, however, this results in higher mechanical loads on the cartridge valve. It is therefore advantageous, even for the case of a central fuel connector, to connect it directly to the valve housing in order to reduce mechanical loading on the cartridge. For such a mechanically equilibrated design, the non-magnetizable casing of the cartridge can be made thin-walled with less than 0.2 mm wall thickness. To design the casing with as thin a wall as possible is of advantage from a magnetic perspective. In addition, the proposed dimensions and methods of connecting are to be considered as suitable, but only as examples. For instance, in place of press-connections, threaded connections could be employed. By way of example, it might be suitable to consider inside the casing a threaded connection for the magnetic pole or the valve carrier, and to set the armature stroke by the depth of the corresponding thread mounting. In addition, since a fuel filter will always be part of the valve, separate representation of it has been omitted. These measures are a matter of course for those skilled in the art.

Additional suitable designs and variants of the valve according to the invention can be deduced from the claims.

I claim:

1. In an electromagnetic fuel injector for an internal combustion engine and comprising an electromagnet, an armature, a magnetic pole, and a valve housing, the improvement comprising a cartridge for supporting said electromagnet having a nonmagnetizable portion and a valve seat wherein said cartridge is surrounded by at least one magnetic coil, said coil being connected to two contact pins and enveloped by at least one magnetic return flow element, and wherein the magnetic return flow element is at least partly formed by a cap which is open on one side.

2. In an electromagnetic fuel injector for an internal combustion engine and comprising an electromagnet, an armature, a magnetic pole, and a valve housing, the improvement comprising a cartridge for supporting said electromagnet having a nonmagnetizable portion and a valve seat wherein said cartridge is surrounded by at least one magnetic coil, said coil being connected to two contact pins and enveloped by at least one magnetic return flow element, wherein the magnetic return flow element is in the form of a bracket and wherein the magnetic coil is inserted into one side of the magnetic return flow element.

3. In an electromagnetic fuel injector for an internal combustion engine and comprising an electromagnet, an armature, a magnetic pole, and a valve housing, the improvement comprising a cartridge for supporting said electromagnet having a nonmagnetizable portion and a valve seat wherein said armature is cylindrical in shape and equipped with a needle valve, said armature having a diameter of about four millimeters, said armature having an armature pole surface of less than ten square millimeters, said armature having a mass of from one-half gram to one gram, said armature having a stroke of from one-tenth millimeter to two-tenths millimeter.

4. An electromagnetic fuel injector according to claim 3 wherein the working gap is located inside the magnetic coil centrally thereof.

5. An electromagnetic fuel injector according to claim 3 wherein the armature has a damping chamber internally thereof, said chamber being connected by means of at least one damping slot with the surrounding space, and that the depth of the damping slot is preferably about 20 micrometers.

6. An electromagnetic fuel injector according to claim 3 and wherein said armature has a damping chamber which has a reset spring internally thereof.

7. An electromagnetic fuel injector according to claim 6 wherein said reset spring has a positioning pin internally thereof having a diameter of about 1–2 mm.

8. An electromagnetic fuel injector according to claim 3 wherein the valve needle extends through the armature and closes directly at the magnetic pole, the closing surface being approximately 1–2 $mm^2$.

9. An electromagnetic fuel injector according to claim 3 wherein the face-surface of the armature is provided with one or more hydraulic damping slots having a depth to exceed 20 micrometers.

10. In a fuel injector for an internal combustion engine, said fuel injector comprising an injector body having an electromagnet, a non-magnetic tube passing through said electromagnet a magnetic pole member inserted into said tube, a magnetically conductive armature that is inserted into and guided by said tube for motion lengthwise of said tube in response to energizing and de-energizing of said electromagnet, a valve member that is operated by the motion of said armature to seat on and unseat from a valve seat, a fuel inlet of a fuel passage leading to an inlet side of said valve seat, and said valve seat having an outlet side which lies opposite its inlet side and via which the fuel injector injects fuel into the engine, the improvement which comprises said valve seat, said non-magnetic tube, said valve member, said armature, and said magnetic pole member being assembled together to form a cartridge sub-assembly unit in which relative positions of said magnetic pole member and said valve seat are fixed in relation to said non-magnetic tube, and said cartridge sub-assembly unit being assembled as a unit into said valve body.

11. The improvement set forth in claim 10 in which said fuel passage includes aperture means extending through the sidewall of said non-magnetic tube.

* * * * *